US005777583A

United States Patent [19]

Canora et al.

[11] Patent Number: 5,777,583

[45] Date of Patent: Jul. 7, 1998

[54] HIGH GAIN BROADBAND PLANAR ANTENNA

[75] Inventors: Frank J. Canora, Millbrook, N.Y.; William Burrell Nunnery, Cary, N.C.; Saila Ponnapalli, Fishkill, N.Y.; Brian Scott Oakley, Burlington, N.C.; Modest Michael Oprysko, Mahopac, N.Y.

[73] Assignee: International Business Machines Corporation, Armonk, N.Y.

[21] Appl. No.: 428,977

[22] Filed: Apr. 26, 1995

[51] Int. Cl.[6] ..... H01Q 1/38

[52] U.S. Cl. ..... 343/700 MS; 343/830; 343/846

[58] Field of Search ..... 343/700 MS, 829, 343/830, 831, 846, 847, 848; H01Q 1/38

[56] References Cited

U.S. PATENT DOCUMENTS

| | | | |
|---|---|---|---|
| 3,587,107 | 6/1971 | Ross | 343/830 |
| 4,366,484 | 12/1982 | Weiss et al. | 343/700 MS |
| 4,651,159 | 3/1987 | Ness | 343/700 MS |
| 4,697,189 | 9/1987 | Ness | 343/700 MS |
| 4,827,266 | 5/1989 | Sato et al. | 343/700 MS |
| 4,829,309 | 5/1989 | Tsukamoto et al. | 343/830 |
| 4,940,991 | 7/1990 | Sheriff | 343/795 |
| 4,994,820 | 2/1991 | Suzuki et al. | 343/700 MS |
| 5,121,127 | 6/1992 | Toriyama | 343/700 MS |
| 5,355,142 | 10/1994 | Marshall et al. | 343/700 MS |
| 5,406,292 | 4/1995 | Schnetzer et al. | 343/700 MS |
| 5,434,579 | 7/1995 | Kagoshima et al. | 343/700 MS |
| 5,471,221 | 11/1995 | Nalbandian et al. | 343/700 MS |

*Primary Examiner*—Hoanganh T. Le

[57] ABSTRACT

The antenna is a hybrid microstrip and reflector antenna having a planar patch antenna mounted to an upper surface of an insulated planar substrate. The substrate is coupled to a ground plane by one or more insulated couplers so as to form an airgap therebetween. A coaxial cable connectable to a transceiver is coupled to the bottom surface of the ground plane at the outer conductor thereof and the inner conductor is coupled to a feed pin which passes through the ground plane and protrudes through the surface of the patch. The feed pin is secured to the patch by soldering.

7 Claims, 3 Drawing Sheets

HIGH GAIN BROADBAND PLANAR ANTENNA

FIELD OF THE INVENTION

The invention relates to antennas, and in particular to planar antennas.

BACKGROUND OF INVENTION

Broadband, high gain planar antennas are required for many wireless applications, including wireless local area networks (LANs), wide area networks (WANs) and personal area networks (PANS). The antennas are used with access points or base stations, and are mounted on a wall or ceiling. It is desirable for such antennas to be unobtrusive and have a low profile. Prior art antennas (e.g., parabolic dish, horn, reflector and Yagi antennas) have failed in this regard. The high gain of such antennas, however, is effective in providing coverage over a large area, due to increased radiation in a given direction.

Broadband planar microstrip antennas which provide high gain are difficult to design, because microstrip antennas are inherently very narrowband. Since they are resonant structures, they also tend to be very sensitive to process variations and manufacturing tolerances. If not designed carefully, tuning during manufacture is required, thereby making the cost of manufacture prohibitively high. Microstrip antennas also require a very controlled feed structure, so that they are impedance matched over the entire desired band. Controlled feeds can be provided, however, only by using expensive connectors, such as plated through-holes using standard SMA-type connectors, to connect the antenna cable and the antenna.

SUMMARY OF THE INVENTION

The invention is an antenna comprising a planar insulating substrate; a conductive patch secured to an upper surface of the substrate; a ground plane coupled to a lower surface of the substrate by insulating connecting means; the substrate and ground plane forming therebetween an airgap for controlling the bandwidth and gain of the antenna; a feed mechanism having means for coupling the patch and a receiver/transmitter, the mechanism comprising a coaxial cable, one conductor of which is electrically coupled to the ground plane, the other conductor of which is electrically coupled to the patch.

FIGURES

FIG. 1*a* is a plan view of an antenna in accordance with the present invention.

FIG. 1*b* is a sectional view of the plan view of FIG. 1*a*, taken along lines 1*b*.

FIG. 1*c* is a bottom view of the antenna of FIG. 1*a*.

FIG. 2 is a detailed view of a strap used in a preferred embodiment of the invention.

FIG. 3*a* is a plan view of another embodiment of the invention.

FIG. 3*b* is a sectional view taken along lines 3*b* of the embodiment of FIG. 3*a*.

DETAILED DESCRIPTION

Figure 1A:
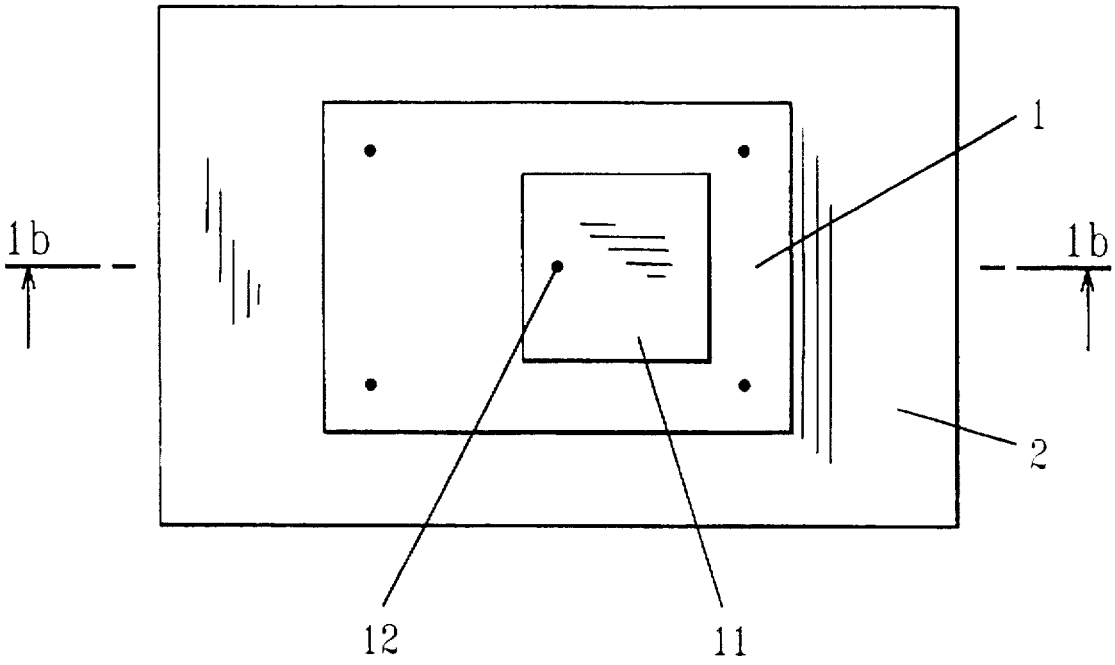
Figure 1B:
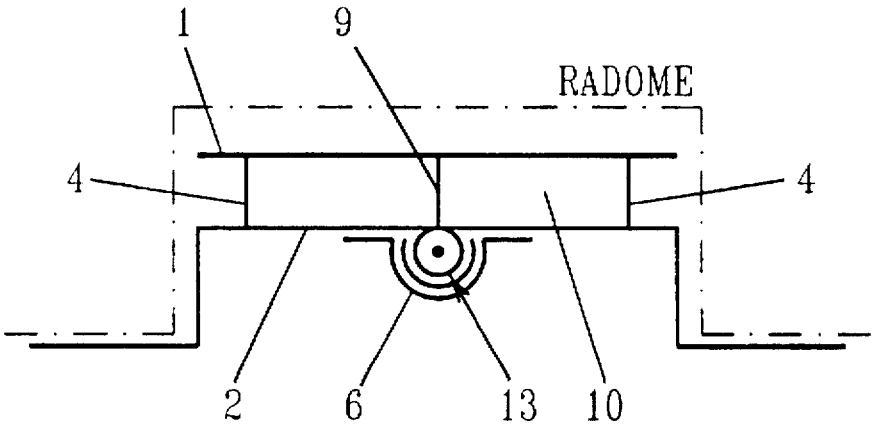
Figure 1C:
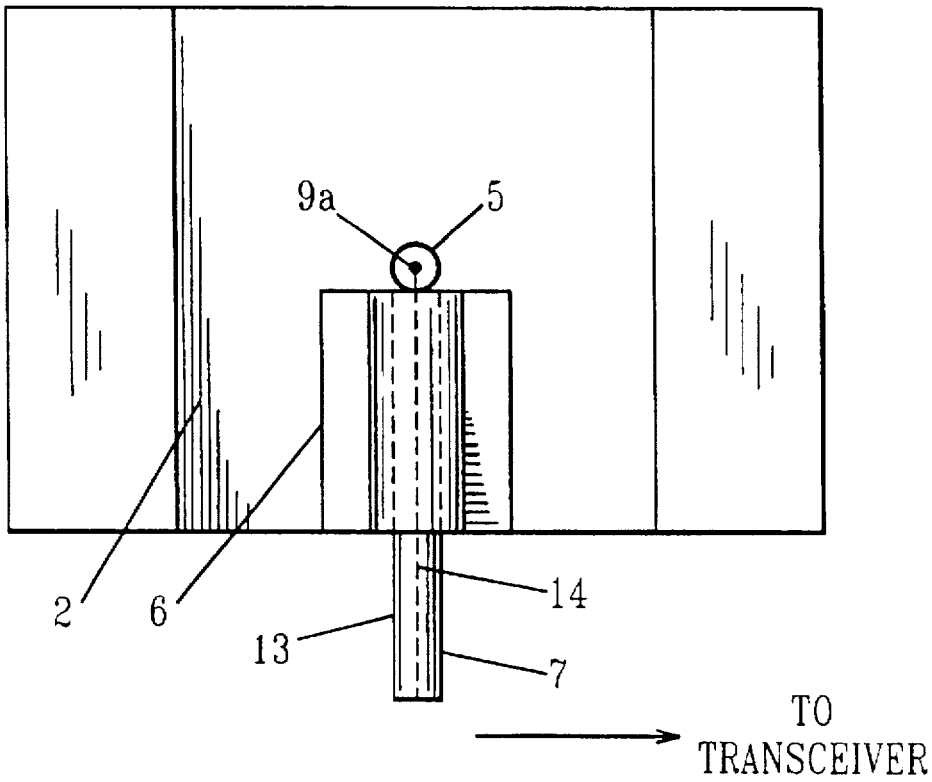

FIGS. 1*a*–1*c* are detailed depictions of a preferred embodiment of the invention. FIG. 1*a* is a plan view of the preferred embodiment of the invention. The antenna includes a patch planar antenna 11 mounted on an insulated planar substrate 1, such as a printed circuit board. The substrate 1 is coupled to a ground plane 2 in a manner to be discussed later. The patch antenna 11 is coupled to a transmitter or receiver via a conductor by means of feed 12. The ground plane 2 is made of a conducting material (aluminum or tin plated steel in a preferred embodiment). FIG. 1*b* shows a cross section of the antenna of FIG. 1*a*. As can be seen in FIG. 1*b*, insulated substrate 1 is separated from ground plane 2 by means of insulated standoffs 4. This separation results in the formation of an airgap 10 between the substrate and ground plane. The airgap serves two purposes: 1) to increase the gain of the antenna; and 2) to increase the bandwidth of the antenna. More specifically, the wider the airgap, the larger the gain and the wider the operating band. The standoffs 4, which both separate and couple the substrate and the ground plane, preferably are nylon insulating standoffs which are readily available off-the-shelf.

Figure 2:
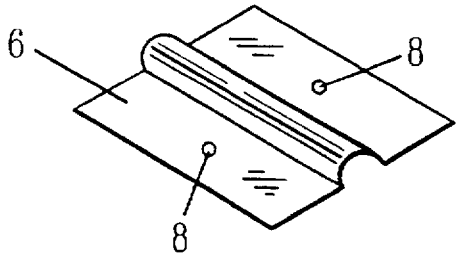

The antenna 11 is coupled to a transmitter or receiver via a coaxial cable 13 which is passed to the feed 12 through a hole 5 in the ground plane. The coaxial cable is uninsulated on its exterior surface proximate the ground plane and the exposed outer conductor 7 of the cable is placed in electrical contact with the bottom surface of the ground plane by means of a bracket, or "strap", 6 (shown in detail in FIG. 2). The strap and ground plane are coupled by rivets 8 so that no soldering is required to the ground plane. This is advantageous because the ground plane is a large heat sink, and is therefore difficult to solder quickly. This riveting process makes manufacturing of the antenna of the present invention very inexpensive. Also in a preferred embodiment, a conductive foam is disposed between the outer conductor 7 of the cable and the strap 6 to ensure a continuous ground.

The center conductor 14 of the coaxial cable is coupled to the patch antenna as follows. The center conductor is soldered at a point 9*a* to a feed pin 9. The feed pin 9 extends vertically up through the airgap defined by the ground plane and substrate and protrudes through the substrate and patch at a desired location in the patch and is fixed to the patch by soldering. Thus, the center conductor can be coupled to the patch antenna without the use of expensive connectors.

The entire cable assembly (including the soldered connection to the patch) provides a controlled impedance feed structure (50 ohms) to the patch, which allows the voltage standing wave ratio (VSWR) to be kept low (<2.0:1.0 (i.e., less than −9.6 dB of power is reflected back to the transceiver) over the 2.4 GHz–2.484 GHz band). This configuration also allows manufacturability without tuning.

Figure 3A:
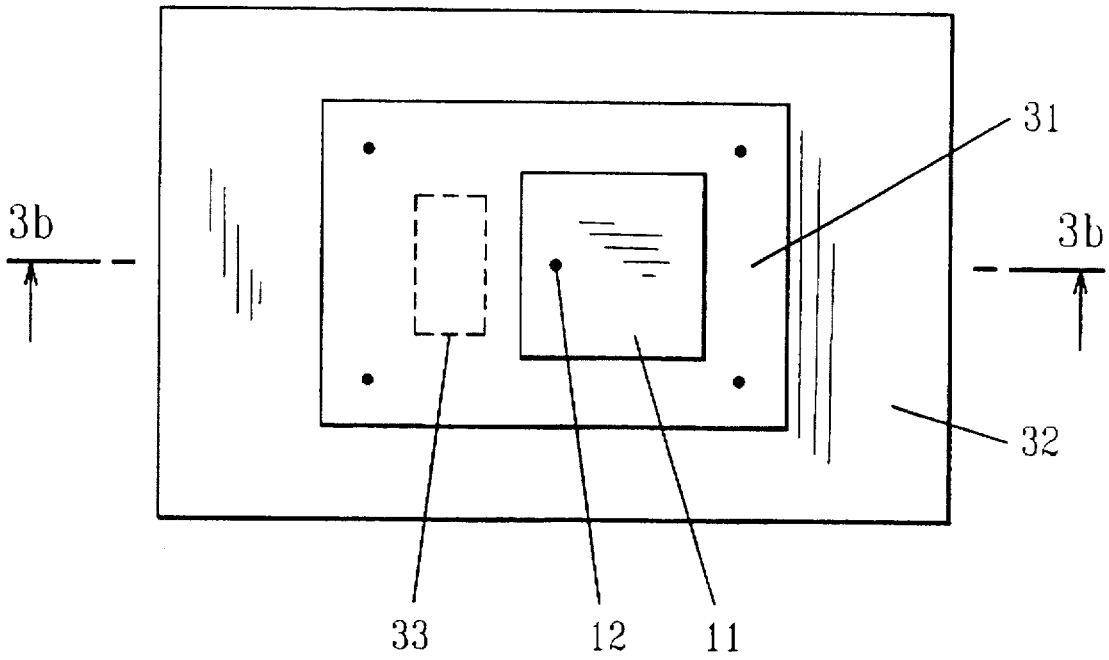
Figure 3B:
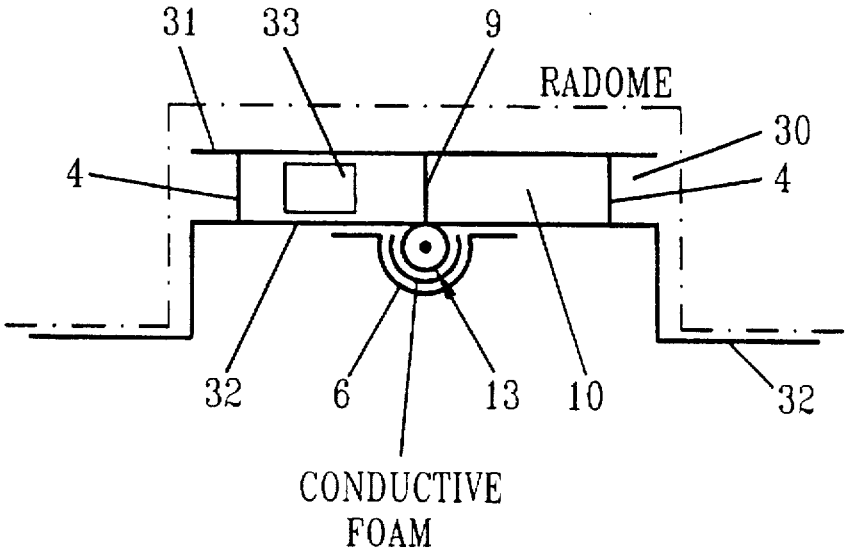

Referring now to FIG. 3*a*, another embodiment of the invention will be described. The embodiment of FIG. 1 can be modified to a different operating frequency band by means of placing a dielectric material 33 in the airgap 30 separating the substrate 31 and the ground plane 32. As can be seen, the dielectric needn't fill the entire airgap. Rather, a dielectric having only the necessary size to tune the antenna to a desired frequency must be used. Available material, such as foam or nonconductive rubber, can be used. The larger the dielectric material, the lower the resonant frequency of the antenna.

Conclusion

The present invention, as described, is a low-cost, high gain, broadband planar antenna which is a hybrid of the reflector and microstrip design. A preferred embodiment of the antenna has a gain of 11.75 dBi, and a bandwidth of 10% in the ISM 2.4GHz–2.484 GHz band. In the preferred embodiment, the airgap is 0.25", the patch size is 1.634"× 1.634" and the antenna hole in the patch is 0.19" from the bottom and centered. The polarization is either vertical or horizontal depending on the orientation of the antenna with respect to the Earth. The feed can be a simple coaxial line, which is connected, such as by soldering, to a pin vertically disposed between a ground plane and the antenna. This is a low cost, controlled impedance feed which eliminates the need for the expensive connectors between the feed and the antenna that are common in the prior art. The remainder of the antenna is constructed from-off-the shelf components whose tolerances are such that the antenna has center frequency and bandwidth characteristics that are repeatable during manufacture without tuning.

While the invention has been described in particular with respect to preferred embodiments thereof, it will be understood that modifications to the disclosed embodiments can be effected without departing from the spirit and scope of the invention.

What is claimed is:

1. An antenna, comprising:

a planar insulating substrate;

a conductive patch secured to a upper surface of the substrate;

a ground plane coupled to a lower surface of the substrate by insulating connecting means;

the substrate and ground plane defining therebetween an airgap for controlling the bandwidth and gain of the antenna;

a feed mechanism having means for coupling the patch and a receiver/transmitter, the mechanism comprising a coaxial cable extending transversely along a bottom surface of said ground plane, an outer conductor of which is electrically coupled to the ground plane, and an inner conductor of which is electrically coupled to the patch; and a conductive strap secured to the bottom surface of the ground plane by means of one or more fasteners, the coaxial cable being disposed between the strap and the ground plane, the strap thereby facilitating electrical contact between the outer conductor and the ground plane;

wherein the inner conductor is coupled to the patch via a feed pin disposed between the substrate and the ground plane, the feed pin passing through a hole in the substrate and coupling the patch, the feed pin being coupled to the inner conductor through a hole in the ground plane, and the feed pin and the inner conductor are electrically insulated from the ground plane.

2. The antenna of claim 1, wherein the patch antenna is substantially flat and quadrilateral in shape.

3. The antenna of claim 2, further comprising means, disposed within the airgap, for tuning the frequency of the antenna.

4. The antenna of claim 3, wherein the means for tuning comprises a dielectric material.

5. The antenna of claim 1, wherein the fasteners are rivets.

6. The antenna of claim 1, wherein the patch is formed from copper.

7. An antenna, comprising:

a planar insulating substrate;

a conductive patch secured to a upper surface of the substrate;

a ground plane coupled to a lower surface of the substrate by insulating connecting means;

the substrate and ground plane defining therebetween an airgap for controlling the bandwidth and gain of the antenna;

a feed mechanism having means for coupling the patch and a receiver/transmitter, the mechanism comprising a coaxial cable extending transversely along a bottom surface of said ground plane, an outer conductor of which is electrically coupled to the ground plane, and an inner conductor of which is electrically coupled to the patch;

a conductive strap secured to the bottom surface of the ground plane by means of one or more fasteners, the coaxial cable being disposed between the strap and the around plane, the strap thereby facilitating electrical contact between the outer conductor and the ground plane; and a conductive foam disposed between the outer conductor of the coaxial cable and the strap.

* * * * *